US006223362B1

(12) United States Patent
Liang

(10) Patent No.: US 6,223,362 B1
(45) Date of Patent: May 1, 2001

(54) WATER-ABSORBING SINK APRON FOR BATHROOM COUNTERS

(76) Inventor: Betty Bei Liang, 400 Greenwood Dr., Santa Clara, CA (US) 95054

( * ) Notice: Subject to any disclaimer, the term of this patent is extended or adjusted under 35 U.S.C. 154(b) by 0 days.

(21) Appl. No.: 09/498,778

(22) Filed: Feb. 5, 2000

(51) Int. Cl.[7] ..... A47K 1/06

(52) U.S. Cl. ..... 4/655; 4/245.4; 4/245.5; 4/245.6; 4/245.7; 4/245.9

(58) Field of Search ..... 4/655, 654, 658, 4/656, 657, 245.1–245.9, 572.1, 580; 428/122

(56) References Cited

U.S. PATENT DOCUMENTS

| | | | | |
|---|---|---|---|---|
| 1,264,573 | * | 4/1918 | Stevens | 4/245.7 |
| 1,643,413 | * | 9/1927 | Mahoney | 4/245.6 |
| 1,774,217 | * | 8/1930 | Windsor . | |
| 2,817,851 | * | 12/1957 | Barnwell . | |
| 3,915,524 | | 10/1975 | Langston . | |
| 3,988,784 | | 11/1976 | Reedy . | |
| 4,305,166 | | 12/1981 | Rose . | |
| 5,725,933 | * | 3/1998 | Nishiyama | 429/192 |

FOREIGN PATENT DOCUMENTS

| | | | | |
|---|---|---|---|---|
| 2625669 | * | 7/1989 | (FR) | 4/245.4 |
| 2658064 | * | 8/1991 | (FR) | 4/245.5 |
| 0021276 | * | 12/1909 | (GB) | 4/245.9 |
| 2169011 | * | 7/1986 | (GB) | 4/245.4 |

* cited by examiner

*Primary Examiner*—Gregory L. Huson
*Assistant Examiner*—Khoa Huynh

(57) ABSTRACT

A sink apron for absorbing excess water from bathroom sink counters comprising of a towel-like material 24 attached by adhesive or stitches 32 to a layer of light-weight rubber base 26. The sink apron encircles the washbasin in the shape of a semi-oval and is separable into two pieces to provide customization to any sink size. The sink apron easily detaches and reattaches using hook-and-loop fasteners 28, 30 sewn on opposing ends of the pieces. For sinks wherein the sink fixture is built outside of the washbasin, the sink apron comprises of a hole 22 to allow the apron to encircle the sink fixture.

3 Claims, 4 Drawing Sheets

WATER-ABSORBING SINK APRON FOR BATHROOM COUNTERS

BACKGROUND—FIELD OF INVENTION

This invention relates to a decorative sink apron, bib, guard, shroud or cover used to absorb excess water from the sink counter.

BACKGROUND—DESCRIPTION OF PRIOR ART

A bathroom sink is a necessity used for performing daily hygienic rituals, such as: washing, toothbrushing or shaving. After normal use, excess water collects around the sink fixture and basin counter. Water residue also accumulates around bathroom accessories left on top of a sink counter, i.e.: shaving razors, soap dishes, liquid soap dispensers and toothbrush holder—to name few. There are many causes for the excess of water left on the sink counter. Commonly, most household washbasins are not deep enough and/or wide enough in diameter to retain water spillage that is produced from everyday use. In addition, people often leave toiletry items around the washbasin that collect residual water, such as: soap dishes, liquid soap dispenser, toothbrush holders, razors, et al. All of these items accumulate water when handled by wet hands. Sodden bathroom sink counters leave an unattractive and an uninviting appearance for guests, as for anyone else using the bathroom. Residual water that is left over the sink counter may also cause some toiletries to rust, erode or oxidize more quickly than if it were kept dry and sanitary.

As a result, people either use hand towels, sponges or toilet paper to wipe the water around the sink fixture and washbasin. Materials of this sort are good assets for cleaning since towels, sponges and toilet paper are excellent water absorbents. The problem lies within where these materials are stored or kept. Some people leave sponges or a rag towel in the cupboard below the sink. However this is an inconvenient location and is not readily accessible especially for guests who may not know the whereabouts of those items. Other people leave rags or towels on top of the counter for easy access. However, rags left randomly on top of the sink counter make an unpleasant scene in the bathroom. Some people use toilet paper out of convenience but are still intolerant of its friable material. While these are commonly used alternatives, none provide a clean, carefree solution.

Because wiping around a washbasin after each use is a time-consuming and pesky task, people may simply choose not to do it. Those who choose to do it, do so at the expense of valuable time wasted each trip to the bathroom. The first scenario ignores the problem and the second is inefficient and time-consuming.

Several types of sink covers have been proposed including U.S. Pat. Nos. 3,988,784 to Reedy (1976), and 3,915,524 to Langston (1975). However, neither of these covers were invented for the purpose described herein. A more similar U.S. Pat. No. 4,305,166 to Rose (1981) is a reversible sink cover that is adapted to fit into the well of a kitchen sink to cover the sink when not in use. The functionality and materials described in Rose's invention are in no relation to my invention, which serves as a water absorbing apron for bathroom sinks.

OBJECTS AND ADVANTAGES

Several objects and advantages of the present invention are:

(a) To provide an inexpensive, carefree solution to maintaining the appearance of a well-groomed bathroom. Due to its low manufacturing and production costs, it is affordable for all consumers. Because it is affordable, it is easily disposable after normal wear and tear. Its disposability serves as a strong selling point in increasing repeat sales.

(b) To provide a portable, durable sink apron that offers convenience and timesaving benefits by eliminating "after wash fuss." The sink apron is non-obtrusive so toiletries can be set on top. Sinks stay dry after each wash.

(c) To provide not only a practical, but also fashionable bathroom accessory. Sink aprons of all assorted designs and colors will be made as a decorative bathroom accessory and can be part of a complete bathroom set.

(d) To provide an easy-to-use, easy-to-clean protective sink cover. The sink apron can be removed and cleaned at any time using any conventional washer and dryer.

(e) To provide a hassle-free, "one size fits all" purchase decision that can accommodate most circular sinks.

Further objects and advantages are to provide a sink apron that will fit most circular sinks. The sink apron is adjustable b means of hook-and-loop fasteners that make the sink apron modular and flexible to most circular sinks. Since sinks vary in diameter size of the basin, the sink apron is adjusted to fit the largest standard circular sink. To customize fitting only smaller sinks, simply detach and re-attach the hook-and-loop fasteners. The advantage to having "one size fits all," is that consumers are not required to measure the diameter of their sink basin before purchasing. This benefit lends itself to impulsive purchasing power.

Still further, the sink apron is removable and can be cleaned and dried at any time using any conventional laundry washer and dryer.

DRAWING FIGURES

In the drawings, closely related figures have the same alphabetic suffixes but different numbers. FIGS. 1A to 1C describe a sink apron designed for sink models whereby the fixture is connected to the sink basin. FIGS. 2A to 2C described a sink apron designed for sink models whereby the fixture is not connected to the sink basin.

REFERENCE NUMERALS IN DRAWINGS

Figure 1A:
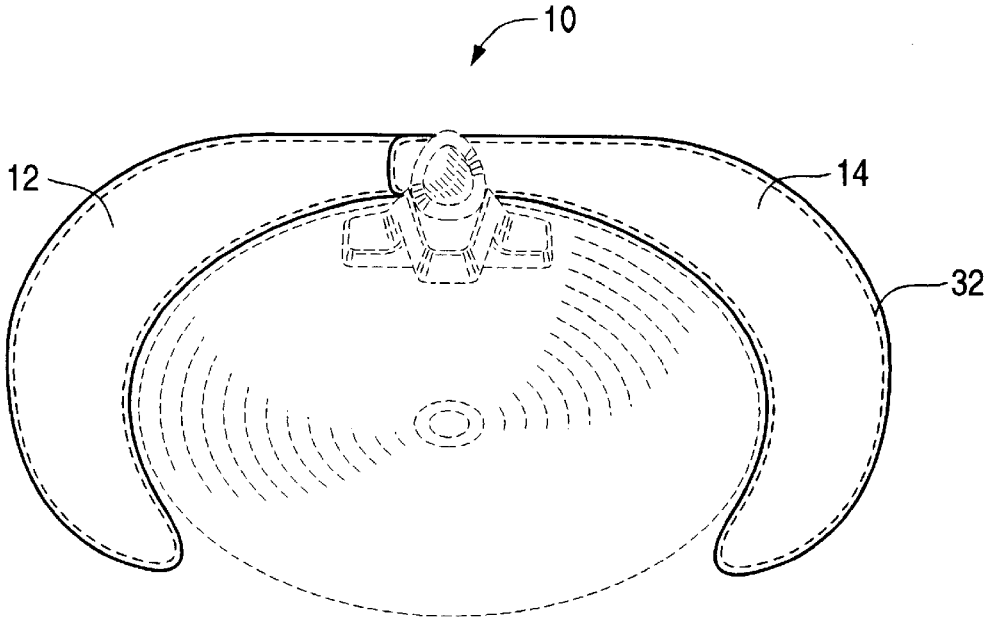
FIG. 1A illustrates how the sink apron would appear in actual use on a sink whereby the fixture is connected to the sink basin.
Figure 2A:
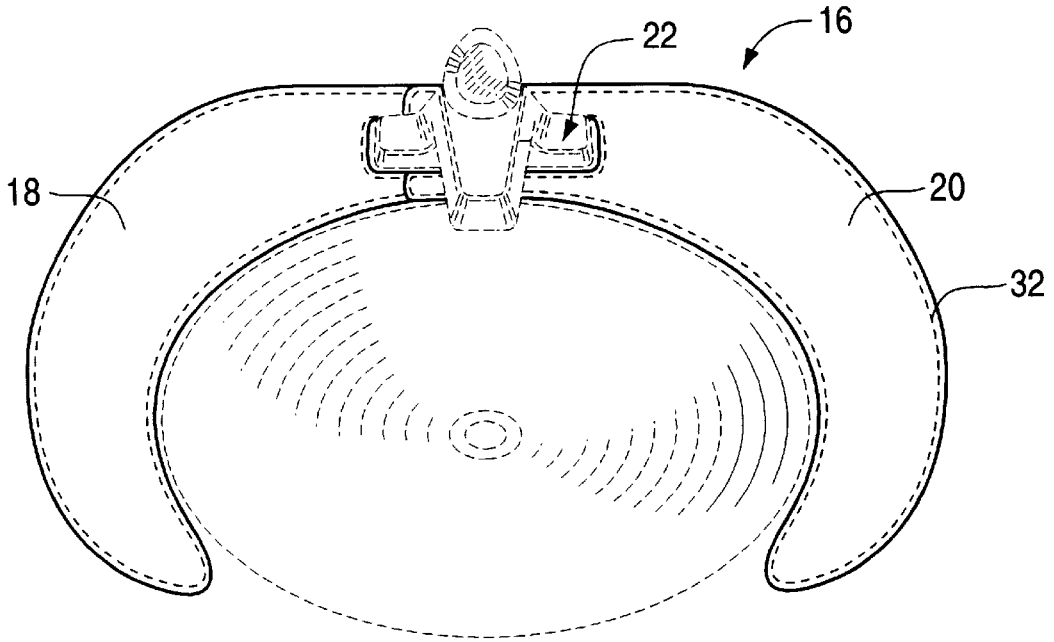
FIG. 2A illustrates how the sink apron would appear in actual use on a sink whereby the fixture is not connected to the sink basin.

10 Full embodiment of the sink apron described in FIG. 1A.
12 Left piece of the sink apron described in FIG. 1A.
14 Right piece of the sink apron described in FIG. 1A.
16 Full embodiment of the sink apron described in FIG. 2A.
18 Left piece of the sink apron described in FIG. 2A.

20 Right piece of the sink apron described in FIG. 2A.
22 Hole for the sink fixture to protrude in the sink apron described in FIG. 2A.
24 Towel or terry-cloth material
26 Rubber material
28 Hook fasteners
30 Loop fasteners
32 Stitching

SUMMARY

The sink apron comprises of a towel-like material stitched to a rubber-matted base that easily rests on top of the sink counter. It is adjusted to fit the largest standard sink and can be fitted onto smaller sinks by detaching the hook-and-loop fasteners and overlapping the right and left pieces.

DESCRIPTION—FIGS. 1A TO 1C AND FIGS. 2A TO 2C

Figure 1B:
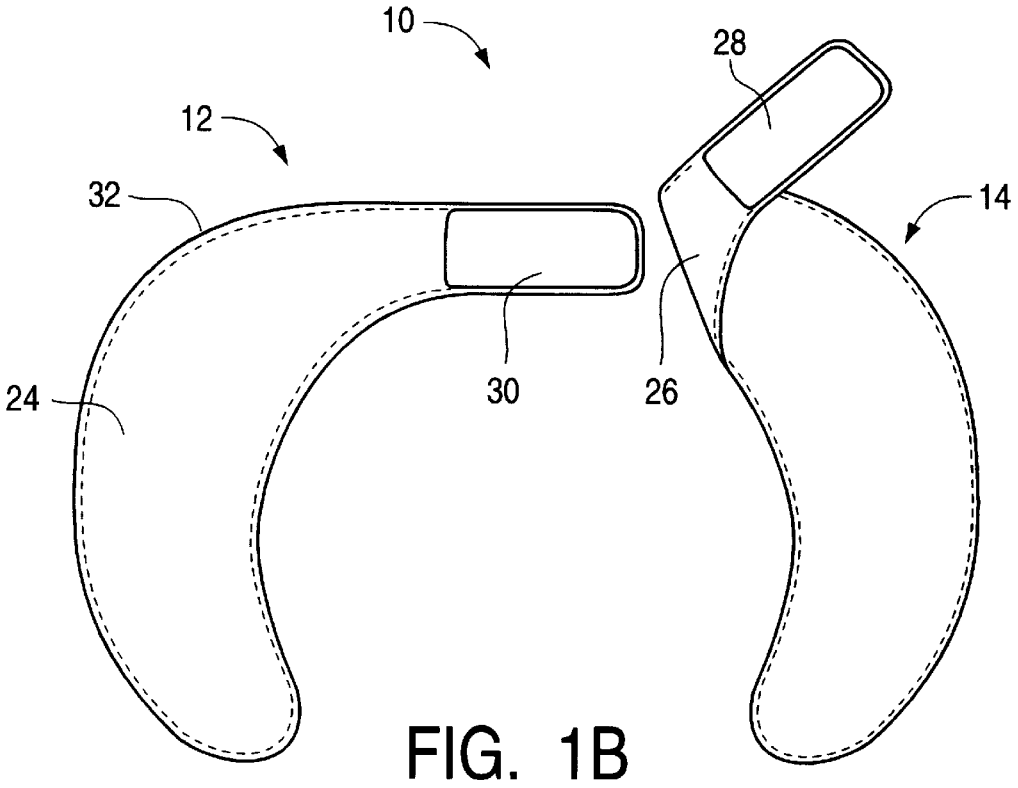
FIG. 1B illustrates the top-view of the sink apron described in FIG. 1A whereby the apron is detached by its hook-and-loop fasteners.

FIG. 1A and FIG. 2A illustrate how the present invention would appear on a sink counter in actual use. The sink apron in FIG. 1A is designed for sink models whereby the sink fixture is built into the washbasin. As illustrated in FIG. 1B, the sink apron 10 comprises of two sides shaped into a semi-circle. The sink apron is adjustable to the diameter of the basin by pulling apart the right side of the apron 14 and overlapping it onto the left side of the apron 12 to reattach in the form of a semi-oval.

Figure 2B:
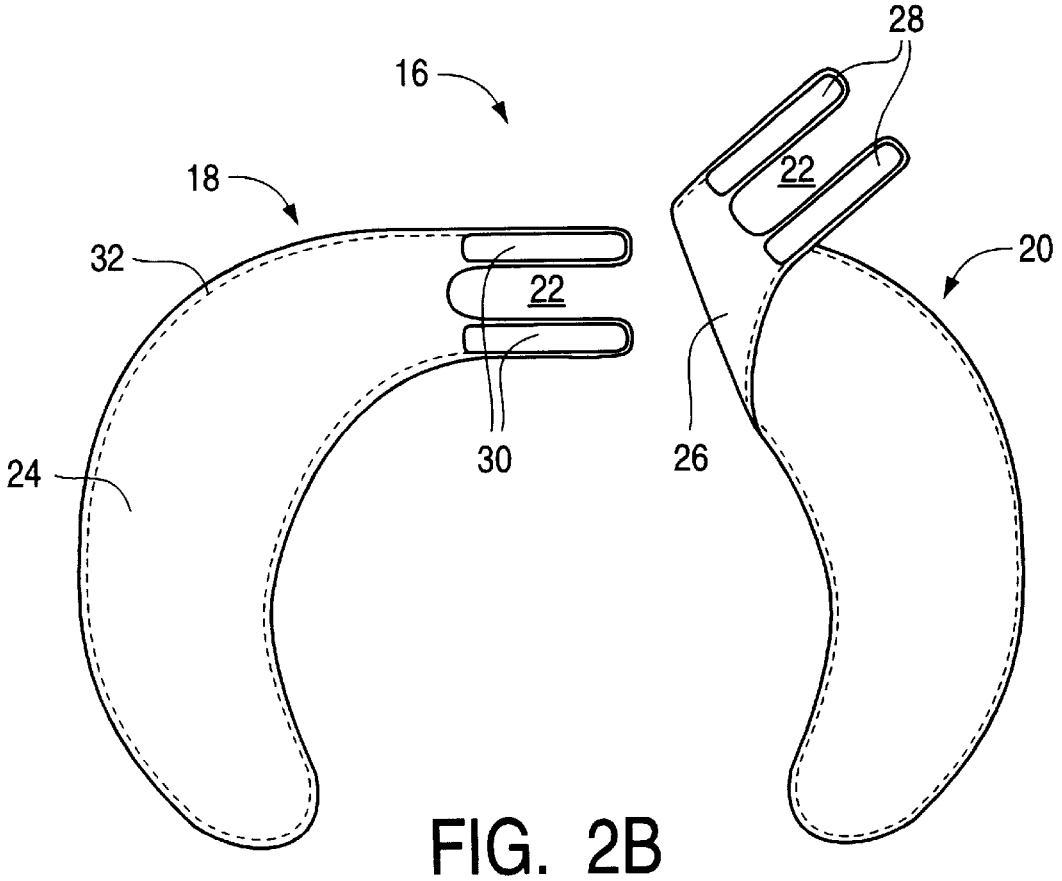
FIG. 2B illustrates the top-view of the sink apron described in FIG. 2A whereby the apron is detached by its hook-and-loop fasteners.

The sink apron in FIG. 2A is functionally identical to the sink apron in FIG. 1A, except that it is designed for sink models whereby the sink fixture is built outside of the washbasin. As illustrated in FIG. 2B, the sink apron comprises of a hole 22 where the two pieces attach to circumfuse the sink fixture while the embodiment encircles the outside of the washbasin in the form of a semi-oval.

Figure 1C:
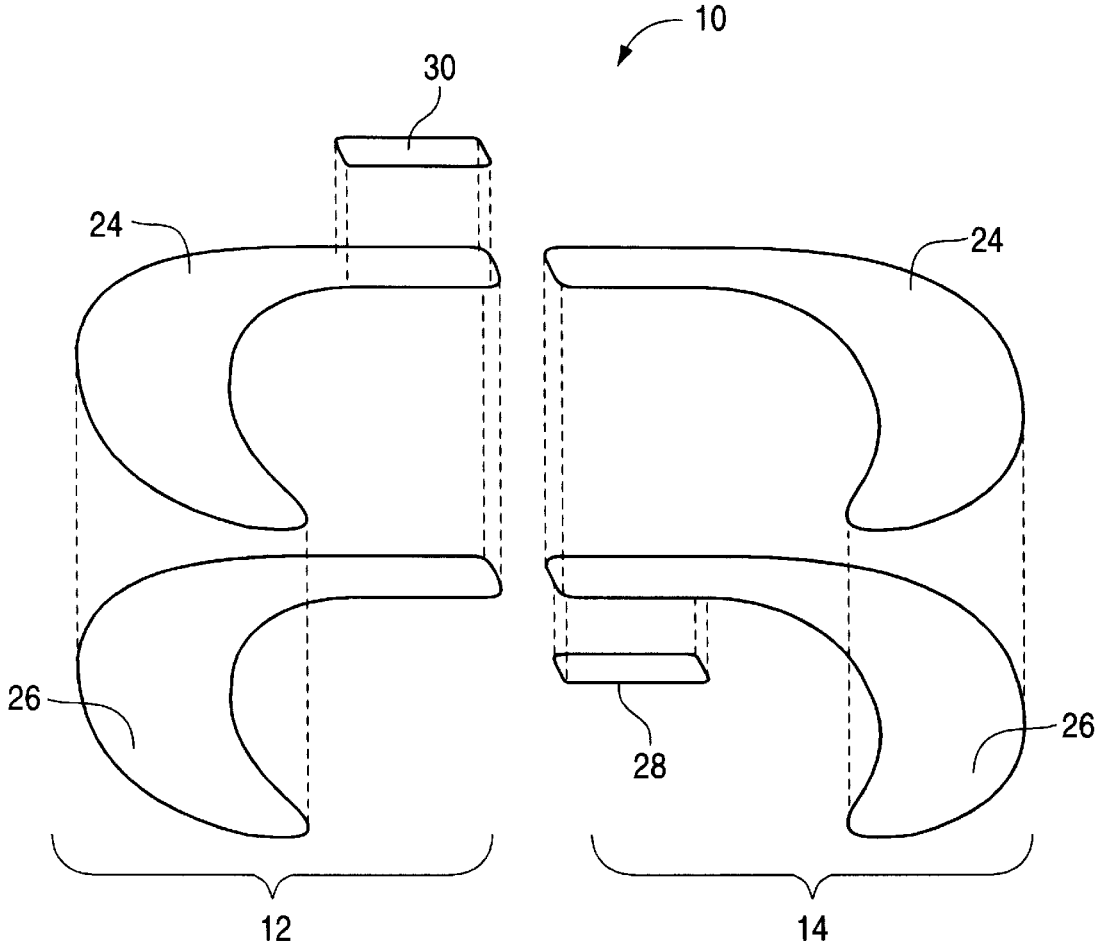
FIG. 1C illustrates a layered view of the sink apron described in FIG. 1A.
Figure 2C:
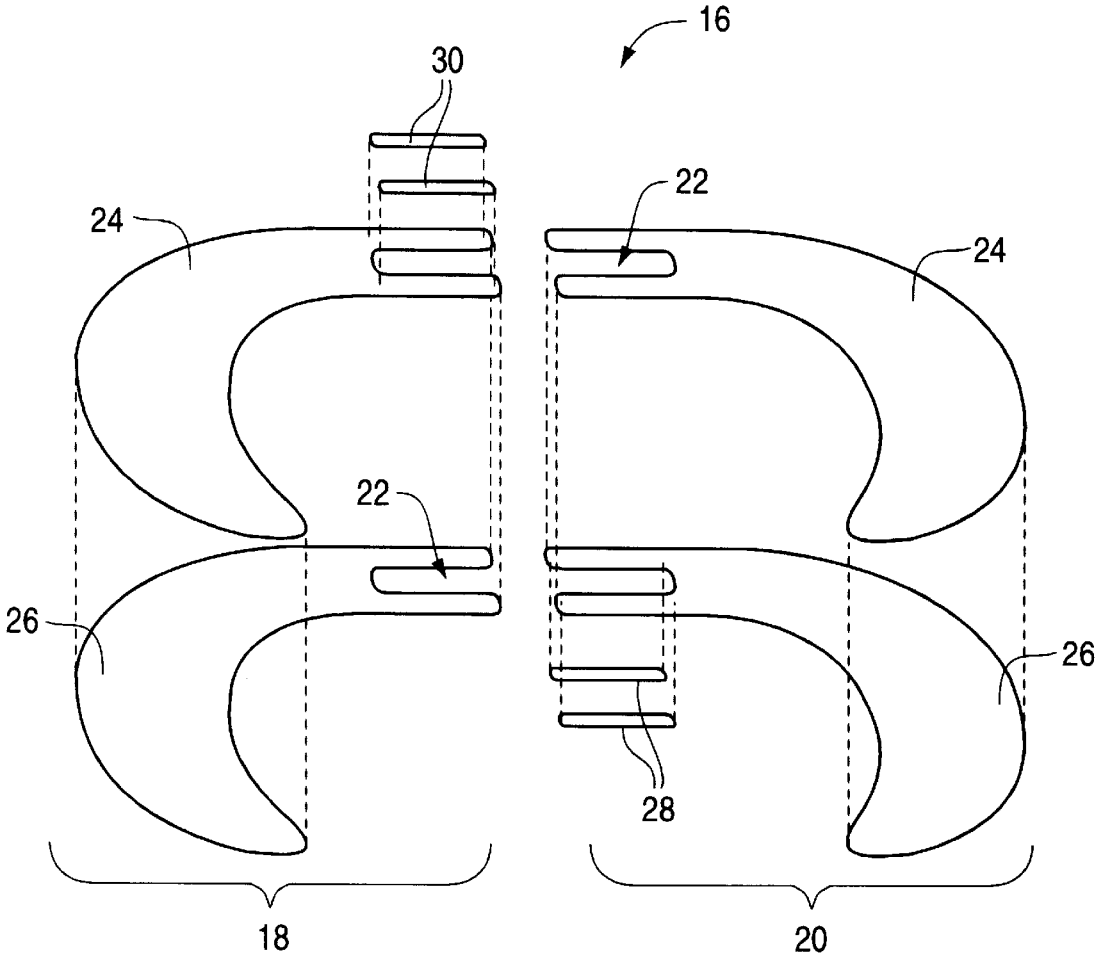
FIG. 2C illustrates a layered view of the sink apron described in FIG. 2A.

The construction of the layout of the present invention is illustrated in FIG. 1C and FIG. 2C (layered view). This invention consists of a towel-like material 24 that is attached to a layer of rubber 26 or some other form of lightweight, tacky synthetic material by means of stitches 32. As illustrated in FIG. 1B and FIG. 2B, the invention is separable into two pieces which overlap to adjust to the diameter of the basin. In the preferred embodiments, the left pieces 12 and 18 comprise of a layer of loop fasteners 30 stitched 32 with the loops exposing outward from the towel-like material 24. Thus, in order for the two pieces to attach, the right pieces 14 and 20 comprise of a layer of hook fasteners 28 stitched 32 with the hooks exposing outward from the rubber base 26.

FIG. 1B and FIG. 2B illustrate how the invention would appear once manufactured into single unit. As shown in FIG. 1B, the sink apron detaches by pulling apart the left side 12 and right side 14 and reattach by overlapping the side with the hook fasteners 28 sewn under the rubber layer 26 to the side with the loop fasteners 30 sewn to the top of the towel material 24. The sink apron shown in FIG. 2B is functionally identical to that of FIG. 1B. The larger the washbasin, the further apart the pieces attach. The smaller the washbasin, the pieces overlap closer together.

OPERATION—FIGS. 1B AND 2B

The manner of using the sink apron to absorb excess water from the sink counter is identical in each of the two apron designs FIG. 1B and FIG. 2B. In the preferred embodiment, whereby the loop fastener is attached to the left piece and the hooks fastener is attached to the right piece, one first separates the two pieces and lays them along the washbasin. Next, adjust the pieces to fit in the shape of the one's washbasin. To attach the two pieces together, lift the right piece and place it over the left piece wherein the hook-and-loop fasteners attach themselves, whereby maintaining the shape and the position of sink apron.

The sink apron is shaped to encircle the top-half of the basin where everyday water spillage collects. The towel absorbs water droplets and the rubber base holds the apron securely onto the counter. It is non-obtrusive and therefore, toiletries such as soap dishes, dispensers, toothbrush holders, et al. can be placed over the apron.

CONCLUSIONS, RAMIFICATIONS, AND SCOPE

Accordingly, the reader will see that the towel sink apron offers convenience and timesaving benefits by providing users with a lightweight, durable, easy-to-use protective cover that helps in maintaining the appearance of a well-groomed bathroom. It is portable, inexpensive and disposable and can be used as a decorative bathroom accessory. Its hassle-free "one size fits all" selling point lends itself to the high impulse purchase category. It is a low maintenance product and can be thrown into any conventional washer or dryer along with normal laundry, or disposed of after normal wear and tear.

Currently in the marketplace there are two predominant types of basin shapes: circular/ovular and rectangular. The present invention is only suited for circular/ovular sinks, which eliminates the need requirements of rectangular sinks. This should not be construed as a limitation on the scope of the invention, but rather as an exemplification of one preferred embodiment thereof. Many other variations are possible. Within the market for circular sinks, there are two predominant categories of sink models: 1) faucet heads that are attached to the sink basin, and 2) faucet heads that rest on the counter and are not attached to the sink basin. Hence, there are two types of sink aprons to fill both market needs. As illustrated, FIG. 1A will accommodate sinks with faucet heads attached to the sink basin and FIG. 2A will accommodate sinks with faucet heads that are not attached to the sink basin.

I claim:

1. An article of material adapted to be placed around a sink and on top of a counter, the article having a body comprising a water-absorbing cloth attached to a base of synthetic material, wherein the water-absorbing cloth attached to the base is designed to encircle the sink while lying on top of the counter to absorb any excess water that collects around the sink on the counter, the article having a shape of semi-ovular form, the article being formed by two pieces that are detachably fastened at ends to one another forming a longitudinal side of the semi-ovular form, the longitudinal side ends further comprising hook-and-loop fasteners sewn to the ends at the base thereof which allows the two pieces to fasten to each other by overlapping one end over another to establish the longitudinal side of the semi-ovular form.

2. The article of material of claim 1 wherein said water-absorbing cloth is attached to the base by means of stitches or adhesive.

3. The article of material of claim 1 wherein said article is adjustable to various sizes to accommodate different size sinks by detaching the two ends and reattaching them with a different overlap.

* * * * *